United States Patent [19]

Gustafson

[11] 4,103,364

[45] Aug. 1, 1978

[54] VENTED WATERPROOF PANTS

[76] Inventor: Burch O. Gustafson, 2677 S. Shore Blvd., White Bear Lake, Minn. 55110

[21] Appl. No.: 737,383

[22] Filed: Nov. 1, 1976

[51] Int. Cl.[2] ..... A41B 9/04

[52] U.S. Cl. ..... 2/406; 2/111;407;408

[58] Field of Search ..... 2/406; 128/288

[56] References Cited

U.S. PATENT DOCUMENTS

| | | | |
|---|---|---|---|
| 2,016,355 | 10/1935 | Alsop | 2/406 |
| 3,332,423 | 7/1967 | Whalen | 2/406 |
| 4,009,495 | 3/1977 | Faust | 2/406 |

FOREIGN PATENT DOCUMENTS

| | | | |
|---|---|---|---|
| 791,354 | 8/1968 | Canada | 2/406 |

*Primary Examiner*—Doris L. Troutman

[57] ABSTRACT

Vented waterproof baby pants that includes a main body section of waterproof material and has a top opening, leg cut outs, front and rear panels, each panel having opposite side edges extending between the top opening and the respective leg cutout, the adjacent side edges of each panel being joined by a heat seal seam, and elastic bands and open mesh backing strips sewn to the main body section to extend around the top opening and the leg openings. In one embodiment the main body section is provided with a plurality of transversely spaced apertures adjacent to and along the main body section top edge and the leg cutout edges that are on either transverse side of each of the side edges. In the second embodiment parts of the top edge at each transverse side of the waist opening and parts of the edges of the leg opening edge are secured together to provide side gussets. A plurality of vent apertures are provided in the side gussets to open to the interior of the pants.

7 Claims, 8 Drawing Figures

VENTED WATERPROOF PANTS

BACKGROUND OF THE INVENTION

Waterproof baby pants that have vented side portions.

Each of U.S. Pat. Nos. 1,353,750; 2,544,069 and 3,150,665 disclose waterproof baby pants having side vent portions. In order to provide improvements over the pants of such patents, this invention has been made.

SUMMARY OF THE INVENTION

Baby pants that have a panel portion permitting air flow directly into the interior of the pants which include a waterproof panel portion that has at least one row of vent apertures in the side of the pants. Preferably the row is located adjacent the waistband or leg opening or body, and covered by an open mesh strip forming part of the waistband; or is located in a gusset extending between the waistband and leg opening to have the apertures open directly to the interior of the pants.

Figure 1:
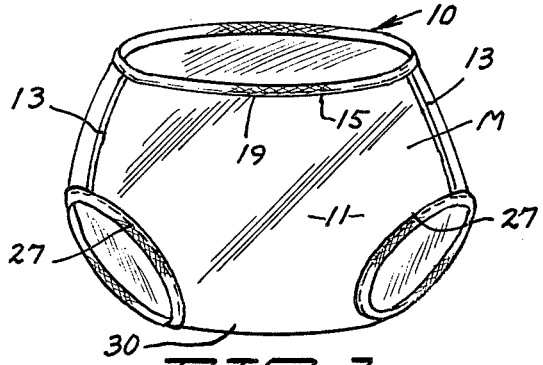
FIG. 1 is a perspective view looking at the front of the first embodiment of the vented baby pants of this invention in a general position as being worn.

Referring now in particular to FIGS. 1-4, the first embodiment of the vented baby pants of this invention, generally designated 10, includes a main body section M that is made of waterproofing material such as a polyvinyl plastic that is slightly stretchable. The main section M includes a front panel 11 and a rear panel 12 that advantageously is made of a single piece of plastic. Further, section M includes leg opening cutouts 22, 23 while the front panel that has generally straight side edges 11C, 11D extending between the front panel top edge 11E and the respective leg cutouts 22 and 23. Similarly, the back panel has generally straight side edges 12C and 12D that extend between the rear panel top edge 12E and the leg cutouts 22 and 23, respectively. The main body section has contiguous edge portions along edges 11C and 12C that are heat sealed together along a heat seal seam 13 that extends the length thereof. Similarly, contiguous edge portions of the front and rear panels adjacent edges 11D and 12D are each sealed together along a heat seal seam 13.

An elastic band 14 along its length is reversely bent over the panel top edges 11E, 12E and an open mesh backing strip 15 along its length is reversely bent over the elastic band. Strip 15 advantageously may be of nylon fabric. The combination of the reversely bent elastic band and backing strip (waistband) extends around the top waist opening 19 of the pants and is sewn by stitching 17 to the front and back panels respectively with either just the elastic band being stretched prior to being sewn to the pants, or the backing strip and front and back panels being gathered, such that the peripheral dimension of the elastic band in a relaxed condition, and thereby the size of the opening 19, is substantially smaller than the combined dimensions of edges 11E, 12E minus on-half of the dimention of any overlap at the heat seal seams 13. As may be noted from FIG. 3, the open mesh backing strip extends a substantial distance more remote from the top edge of the panel than the elastic band; the backing strip being sewn to the panels along the length of the backing strip by stitching 16. The stitching 16 is located in spaced relationship to the stitching 17; each of the front and back panels being provided with a plurality of vent apertures 20 (a row of vent apertures) that are located between the stitching 16 and the stitching 17. As may be noted from FIG. 2, the vent apertures are located adjacent the side edges of the panels on either side of the heat seal seams 13. The maximum spacing of the vent apertures from the adjacent side edge is substantially less than 20% of the transverse distance of the adjacent side edge of the respective panel to the other side edge thereof. Thus, the vent apertures 20 are located such that when the pants are being worn they will be adjacent the hip areas of the baby.

Figure 2:
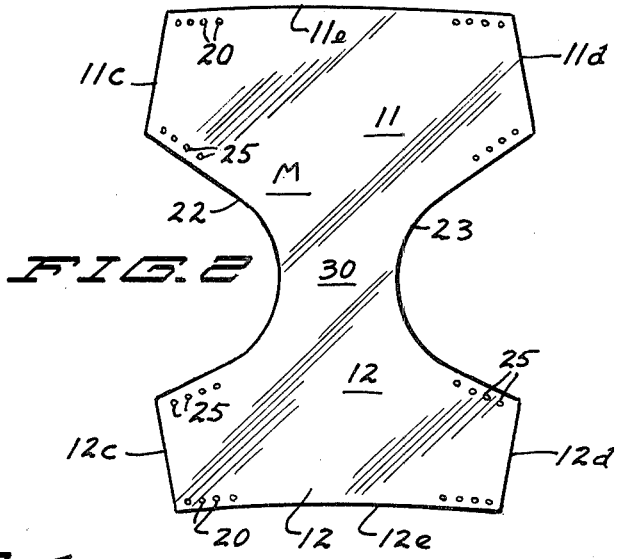
FIG. 2 is a layout of the main section of the pants of FIG. 1.
Figure 3:
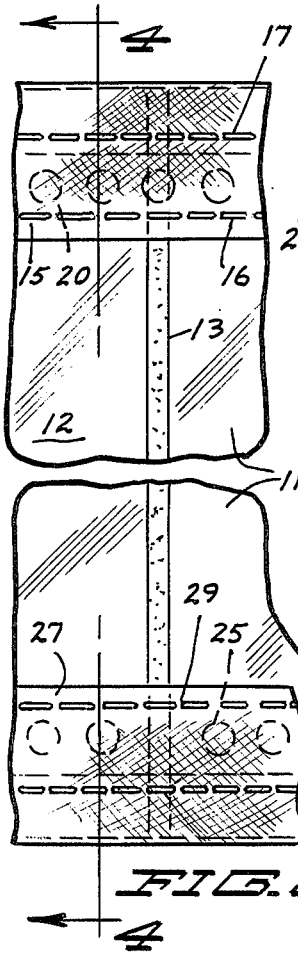
FIG. 3 is a fragmentary view showing a part of the pants of the first embodiment adjacent the upper edge thereof on either side of one heat seal seam at a location adjacent one of the leg cutouts.
Figure 4:
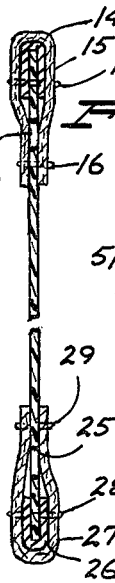
FIG. 4 is a fragmentary longitudinal cross-sectional view generally taken along the line and in the direction of the arrow 4—4 of FIG. 3.
Figure 6:
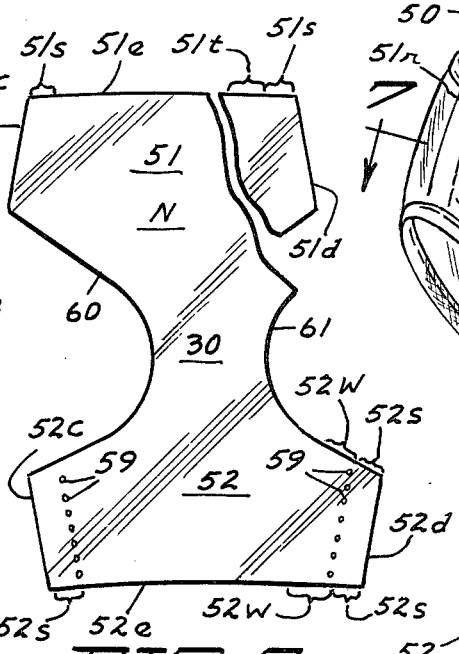
FIG. 6 is a fragmentary view of a layout of the main section of the pants of FIG. 5.
Figure 5:
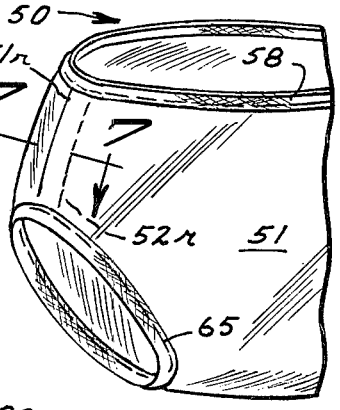
FIG. 5 is a fragmentary perspective view looking at the front of the second embodiment of the vented baby pants of this invention in a general position as being worn.
Figure 8:
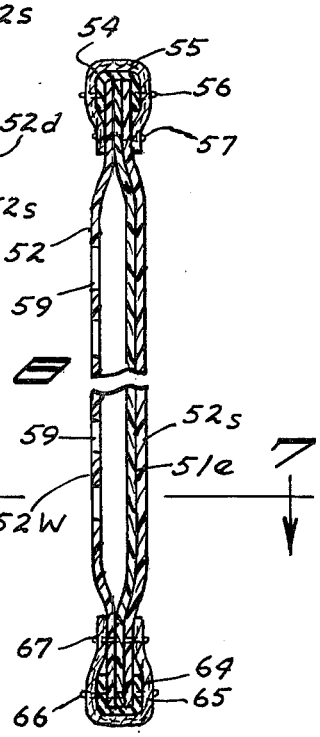
FIG. 8 is a fragmentary longitudinal cross-sectional view generally taken along the line and in the direction of the arrows 8—8 of FIG. 7.

Further, each of the front and rear panels is provided with a plurality of vent apertures 25 (a row of vent apertures) that are adjacent to the respective side edges of the panels and extend along the respective leg cutout edges 22 and 23. The maximum spacing of the vent apertures 25 from the adjacent side edge with the main body section laid out as shown in FIG. 2 is substantially less than 20% of the transverse distance from the adjacent side edge to the opposite side edge of the same panel, whereby apertures 25 are located remote from the crotch area 30. Additionally, the elastic band 26 and an open mesh backing strip 27 are sewed to the panels to extend around the respective leg opening in a manner corresponding to that described with reference to the elastic band and open mesh backing strip for the waist opening. That is, stitching 28 sews the reversely bent backing strip and elastic band to the panels while the stitching 29 sews the open mesh backing strip to the panels at a location on the opposite side of the vent apertures 25 from the stitching 28. The location of the vent apertures is such that they are located along the leg openings remote from the crotch area of the pants, i.e. along the hips of the baby when the pants are being worn. Further, the vent apertures are covered by open mesh material but not by the elastic band. Due to the location of the vent apertures being adjacent the elastic bands of the top waist opening and the leg openings respectively and along the hip area of the pants, the openings are located remote from the normally wettest area of the diaper, when at the same time they permit passage of air directly into and out of the pants when being worn.

Referring now in particular to FIGS. 5-8, the second embodiment of the vented baby pants of this invention, generally designated 50, includes a main body section N that is made of the same material as the main body section of the first embodiment. The main body section N includes a front panel 51 and a rear panel 52 and leg opening cutouts 60 and 61. The front panel 51 has generally straight side edges 51C, 51D extending between the front panel top edge 51E and the respective leg cutout. Similarly, the back panel has general straight side edges 52C, 52D that extend between the rear panel top edge 52E and the leg cutouts. Additionally, the rear panel has a generally longitudinal row of vent apertures 59 that extend along the respective rear panel side edge portion a short distance inwardly from the respective side edge, the apertures being spaced along the major portion of the distance between the leg cutouts and edge 52E. The contiguous edge portions along the side edges of the panels 51 and 52 are heat sealed together along heat sealed seams 53 in a manner similar to that described with reference to the first embodiment; the vent apertures 59 being located adjacent and transversely intermediate the heat sealed seams. The side edge portions of the front panels are reversely bent at fold lines 51R whereby the side edge at each side is adhered at heat sealed seam 53 to a part of the front panel along the length thereof inwardly of said side edge such as in part indicated in FIG. 7. Thus, each front panel side edge portion 51S overlaps part of the adjacent front panel intermediate portion 51T along the longitudinal length thereof. A reversely bent elastic band 54 is extended around the top edges of the panels and an open edge backing strip 54 reversely bent over the band to be sewn to the panel top edge portions with either just the elastic band being stretched prior to sewing, or the backing strip having front and back panels being gathered such that the peripheral dimensions of the elastic band in a relaxed condition and thereby the size of the top opening is substantially smaller than the combined dimensions of the edges 51E, 52E minus approximately 4 times the dimension X, and the dimension of any overlap at the heat seal seams. That is, prior to the sewing of the backing strip and elastic band to the top part of the pants, the back panel at each side is folded such that the back panel side edge portion 52S adjacent edge 52C (52D) is reversably bent at fold line 52R with reference to intermediate rear panel portion 52W. The transverse width of panel portion 52W is designated by X in FIG. 7 as is the combined cimensions of the front panel portion 51S, the heat seal seam and rear panel portion 52S. Further, intermediate panel portion 51T of the front panel is of a transverse dimension X. With the top panel portions folded in a manner indicated in FIG. 7, the top elastic band 54 and backing strip 55 are reversably folded to extend downwardly of the top terminal edges thereof and are sewn at 56, 57 to retain the top edge portions of panel parts 52W, 52S, 51S and 51T in the interleaved relationship indicated in FIG. 7. Similarly, the lower edges of the panels at the leg opening 61 are folded in a manner indicated in FIG. 7 and elastic band 64 and open mesh backing strip 65 are reversely bent over the parts of the panels defining the leg opening and are sewn thereto by stitching 66, 67. With reference thereto, the interior legs of the reversely bent elastic band and backing strip abut against panel part 52W and the exterior legs against panel part 51T to along the stitch lines retain panel part 51T in abutting relationship to panel parts 51S, 52S; and panel parts 51S, 52S in abutting relationship to panel part 52W. As a result the panels are sewn together along the waist opening and the leg opening at 61 to retain the top and lower edges of panel parts 52W, 52S, 51S and 51T secured together with panel parts 51S, 52S being between panel parts 52W and 51T, whereby there is provided a gusset with the vent apertures 59 opening directly through the rear panel interior surface 52A into the interior of the pants and opening between panel portions 52W, 52S. Thus, air can flow directly from the interior of the pants through the vents 59 and thence pass between panel parts 51S, 52W to the ambient atmosphere. In this connection it is to be noted that the aforementioned openings to the atmosphere is in a generally rearward direction, considering the pants being worn by a baby.

Figure 7:
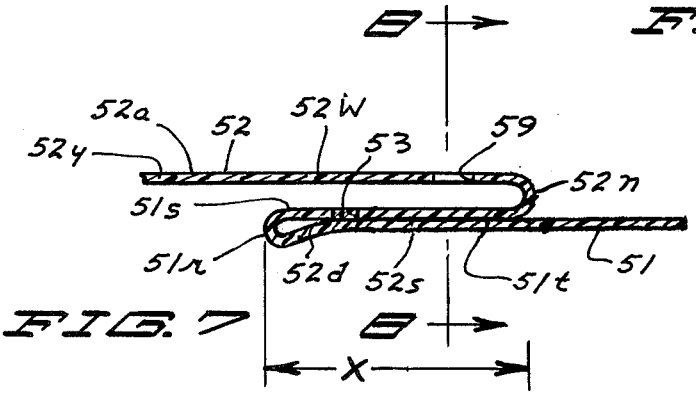
FIG. 7 is a cross-sectional view generally taken along the line and in the direction of the arrows 7—7 of FIG. 5, said view more clearly illustrating the gusset feature of the pants of the second embodiment.

The parts of the panels adjacent edges 52C, 51C are folded in a manner generally indicated in FIG. 7 and described in the preceding paragraph prior to the elastic band and backing strips being sewn thereto whereby there is provided a gusset that opens in a generally rearward direction; the folding to form the gussets at one side being just the reverse of those at the opposite side so that both of the gussets open to the ambient atmosphere in a generally rearward direction when the pants are being worn. Each of the gussets thus extends longitudinally from the top waist opening to the respective leg opening.

During the time that the pants of the second embodiment are being worn panel portion 52W will normally be closely adjacent panel portions 51S, 52S along the lengths thereof between the waistband (54, 55) stitch lines and the leg band (64, 65) stitch lines, as is the corresponding panel portions at the opposite side of the pants; however, with the movement of the baby part of the length of panel portion 51S, 52S will move relative to panel part 52W to permit the flow of air from the interior of the pants, through the vent apertures and to the ambient atmosphere. At the same time panel portion 52S normally overlies the vents 59 in panel part 52W whereby when the baby lies on its side, urine cannot go directly from the diaper onto the blanket. That is, when the baby is lying on that side, the weight of the baby will act to retain the lower panel part 52W against panel part 52S to block flow of urine through the vent apertures in panel part 52W.

When the pants of the second embodiment are in a flat, folded condition and one looks directly at the front of the panel, at each side, panel part 52W would be completely interleaved between panel parts 51S, 52S and the panel part 52Y of the width of dimension X that is on the opposite side of panel part 52W from the fold line 52R. When the pants are being worn by a baby and the baby is in a flat position on its back, panel part 52W usually would not be exposed. However, when the baby moves, for example, portion 51S, 52S momentarily separates from portions 52W sufficiently that air may move through the gusset part of the panel and the vent apertures into or out of the confines of the pants.

As an example of the invention but not otherwise as a limitation thereon, in the first embodiment for one size pants there may be provided five holes 25 at each of the four positions indicated in FIG. 2 and eight holes 25 at each of the four positions indicated with the holes being about 5/64 inch in diameter, spaced 3/16 of an inch apart, and the centers of each hole being spaced approximately 5/16 of an inch from the adjacent panel top edge, bottom edge and leg cutout respectively. The minimum transverse spacing of the leg cutout edges such as shown in FIG. 2 for pants of such a size would be about six inches and the maximum transverse spacing of corresponding parts of said cutout edges would be about 14½ inches. As to the second embodiment, the holes can be of the same diameter as those of the first embodiment, the transverse width dimension X approximately one inch and the corresponding transverse width dimension of panel part 51S approximately ⅜ of an inch.

With reference to FIG. 7, it is to be noted that the normal spacing between panel part 51S, 52W in this view is exaggerated. Also, it is to be understood that the panels 51, 52 may be joined at a heat seal seam located at the location of the fold line 51R. Further, even though the pants have been referred to as baby pants, it is to be understood that the pants may be made of sizes suitable for grown-ups.

What is claimed is:

1. Baby pants having a main body section of waterproof material that has front and rear panels, said panels each having an interior surface, an exterior surface, a top waist opening terminal edge, a first leg opening edge, a second leg opening edge, a first side edge extending longitudinally between the top edge and the first leg edge, a second side edge transversely opposite the first side edge extending between the top edge and the second leg edge, and a crotch area between the leg opening edges, the first and second panels being joined together along the lengths thereof adjacent their first side edges and also joined together along the length thereof adjacent their second side edges, at least one of said panels having a first row of vent apertures adjacent to and extending along one of the opening edges from adjacent one of the first and second side edges toward the other of the first and second side edges, and terminating remote from the said other of the first and second side edges, the vent apertures being in direct air flow communication with the interior of the pants and remote from the crotch area when the pants are in a normal condition of use, an open mesh band extending over the apertures, an elastic waistband adjacent the top edges, an elastic first leg opening band adjacent the first leg opening edge, an elastic second leg opening band adjacent the second leg opening edge, first means for securing the open mesh band and the elastic band that is adjacent to the same opening edge that the apertures are adjacent to the main body section with the apertures more remote from the last mentioned opening edge than the last mentioned elastic band, and second and third means for respectively securing the two elastic bands other than said last mentioned elastic band to the main body adjacent the respective one of the two opening edges other than the one the apertures are adjacent to.

2. The pants of claim 1 further characterized in that the edge the apertures extend along is one of the top waist opening terminal edges.

3. The pants of claim 1 further characterized in that the edge the apertures extend along is one of the leg opening edges.

4. The pants of claim 1 further characterized in that the open mesh band extends around the opening edge that the apertures extend along and that said first means includes a first stitch line between the apertures and the last mentioned edge for securing the elastic band that is adjacent the last mentioned edge to the main body section.

5. The pants of claim 4 further characterized in that the open mesh band is reversely bent over the said last mentioned edge and has a first part extending in abutting relationship to the panel interior surfaces and a second part in abutting relationship to the panel exterior surfaces.

6. The pants of claim 5 further characterized in that the elastic band that is adjacent the edge that the row of aperture is adjacent to is reversely bent over the last mentioned edge and is located between the open mesh band and the panels, the first stitch line also securing the open mesh band and panels together and that the first means includes a second stitch line for securing only the open mesh band and panels together.

7. The pants of claim 4 further characterized in that the first means includes a second stitch line on the opposite side of the row of apertures from the first stitch line and adjacent thereto for securing the open mesh band to the main body section.

* * * * *